US011729571B2

(12) United States Patent
Chinchilla

(10) Patent No.: US 11,729,571 B2
(45) Date of Patent: Aug. 15, 2023

(54) SYSTEMS, DEVICES AND METHODS FOR MULTI-DIMENSIONAL AUDIO RECORDING AND PLAYBACK

(71) Applicant: Rafael Chinchilla, San Jose (CR)

(72) Inventor: Rafael Chinchilla, San Jose (CR)

( * ) Notice: Subject to any disclaimer, the term of this patent is extended or adjusted under 35 U.S.C. 154(b) by 0 days.

(21) Appl. No.: 17/394,145

(22) Filed: Aug. 4, 2021

(65) Prior Publication Data

US 2022/0046374 A1 Feb. 10, 2022

Related U.S. Application Data

(60) Provisional application No. 63/061,000, filed on Aug. 4, 2020.

(51) Int. Cl.
*H04S 7/00* (2006.01)
*H04R 5/027* (2006.01)

(52) U.S. Cl.
CPC ..... *H04S 7/30* (2013.01); *H04R 5/027* (2013.01); *H04S 2400/15* (2013.01)

(58) Field of Classification Search
None
See application file for complete search history.

(56) References Cited

U.S. PATENT DOCUMENTS

2017/0251323 A1* 8/2017 Jo ..... H04S 5/005
2018/0007489 A1* 1/2018 Lehtiniemi ..... G06F 3/165
2019/0132674 A1* 5/2019 Vilkamo ..... H04S 3/00
2019/0253821 A1* 8/2019 Buchner ..... H04R 5/04

* cited by examiner

*Primary Examiner* — Kenny H Truong
(74) *Attorney, Agent, or Firm* — Hani Sayed; Rutan & Tucker, LLP

(57) ABSTRACT

Systems and methods for recording and playback of multi-dimensional sound are described herein. The systems and methods may include positioning a plurality of multi-dimensional sound recording devices in a location and positioning a plurality of multi-dimensional sound recording sensors within the location. Then, acoustical footprint data can be generated. Next, recording positional data within the location utilizing the plurality of multi-dimensional sound recording devices may occur. The systems and methods may continue to generate spatial data utilizing the recorded positional data and store the generated acoustical footprint data and spatial data. An audio mix-down utilizing the stored acoustical footprint and spatial data is generated. Finally, a consumer-device audio track mix based on the audio mix-down can be generated. Further embodiments may also replace audio tracks to mimic the original recording conditions in other languages and environment. Playback may occur on a device that generates a profile of the playback area.

7 Claims, 8 Drawing Sheets

SYSTEMS, DEVICES AND METHODS FOR MULTI-DIMENSIONAL AUDIO RECORDING AND PLAYBACK

PRIORITY

This application claims the benefit of and priority to U.S. Provisional Application No. 63/061,000, filed Aug. 4, 2020, which is incorporated in its entirety herein.

FIELD

The present disclosure technically relates to multi-dimensional sound. More particularly, the present disclosure technically relates to recording, editing, and playback of multi-dimensional sound via one or more multi-dimensional spatial recorders.

BACKGROUND

Currently the recording of sound for film and video is characterized by the sound source being captured by means of a microphone (usually monophonic), whose signal is recorded on a channel of a sound recorder. As many microphones are combined as required and can be mixed within different channels. The common way is to record each audio signal coming from a given microphone on a particular discrete channel in the audio recorder.

Usually in the recording of sound for cinema, the main dialogue is captured by means of a directional microphone placed on a boom arm. At the same time, a Lavalier microphone is often used, hidden in the speaker's clothing, to capture each voice individually. Each signal produced by these microphones is recorded in individual channels, separately and independently. The sounds that accompany the action in a movie are recorded in the same way, either with monaural or stereo microphones in the case of ambient sounds.

All these audio channels are converted into tracks during the sound editing process. The common practice is to keep voices, sound effects, foley, ambience sound, and music separated during the mixdown process, so each one can be processed according to the needs of the sound design.

During this mixdown, the tracks are combined to create a unique soundtrack. As part of that mixing process, the sounds are positioned manually in a three-dimensional environment (panning). Currently, the most widespread standard for movie theatre exhibition is 7.1 and in 5.1 for home distribution. In a 5.1 system for example, two speakers are placed in front of the viewer, one on each left and right side (L, R); two more speakers are placed behind, one on each side (Ls, Rs, the "s" refers to surround); the fifth speaker is placed in front and in the center (C); those are the 5 speakers of the "5.1"; finally the "0.1" refers to the subwoofer or low frequency speaker where the deep sounds have been assigned, typically blows or explosions or simply low frequency contents. In the case of 7.1 surround sound, the distribution is the same, with the difference that there are two more speakers placed on the sides of the hall. The most modern systems include speakers on the ceiling of the cinema which allows a greater precision in the directionality of each sound source [Dolby Atmos].

The mixer engineer has to manually position each sound in the channel/speaker, or combination of channels, in order to achieve the surround effect that is required. In this way, he can make a sound seem to go from one side to another in the room, or from front to back. However, in the current state of art, there is a signal that does not move within this sound space: the human voice. Always, regardless of the character's position in the screen, all voices are always mapped to the central channel of the system.

This is done mainly for economic reasons: when a movie is dubbed in another language, the center channel is simply replaced within the general mix. This way, many versions in different languages are easily obtained, with the same sound and musical effects, with the same surround experience than the original. If the voices of the original film were mixed with the other audio signals, each new version of the film in another language would require a complete new mixdown process, which would be very expensive and impractical. This is why dialog is kept isolated in the center channel.

But this comes with a price: in this current state of the art, there is no way that the voices of the characters—perhaps the most important component of a film—have movement within the sound space. It doesn't matter if a character approaches the camera or runs from one side of the picture to the other, the sound of his voice does not accompany him; it always comes from the central channel of the room. And no matter how separated in the visual space are two characters, their voices will always sound as if they were in the same place. This nothing but a huge creative limitation that will be addressed and solved by this invention.

BRIEF DESCRIPTION OF DRAWINGS

The above, and other, aspects, features, and advantages of several embodiments of the present disclosure will be more apparent from the following description as presented in conjunction with the following several figures of the drawings.

Figure 1:
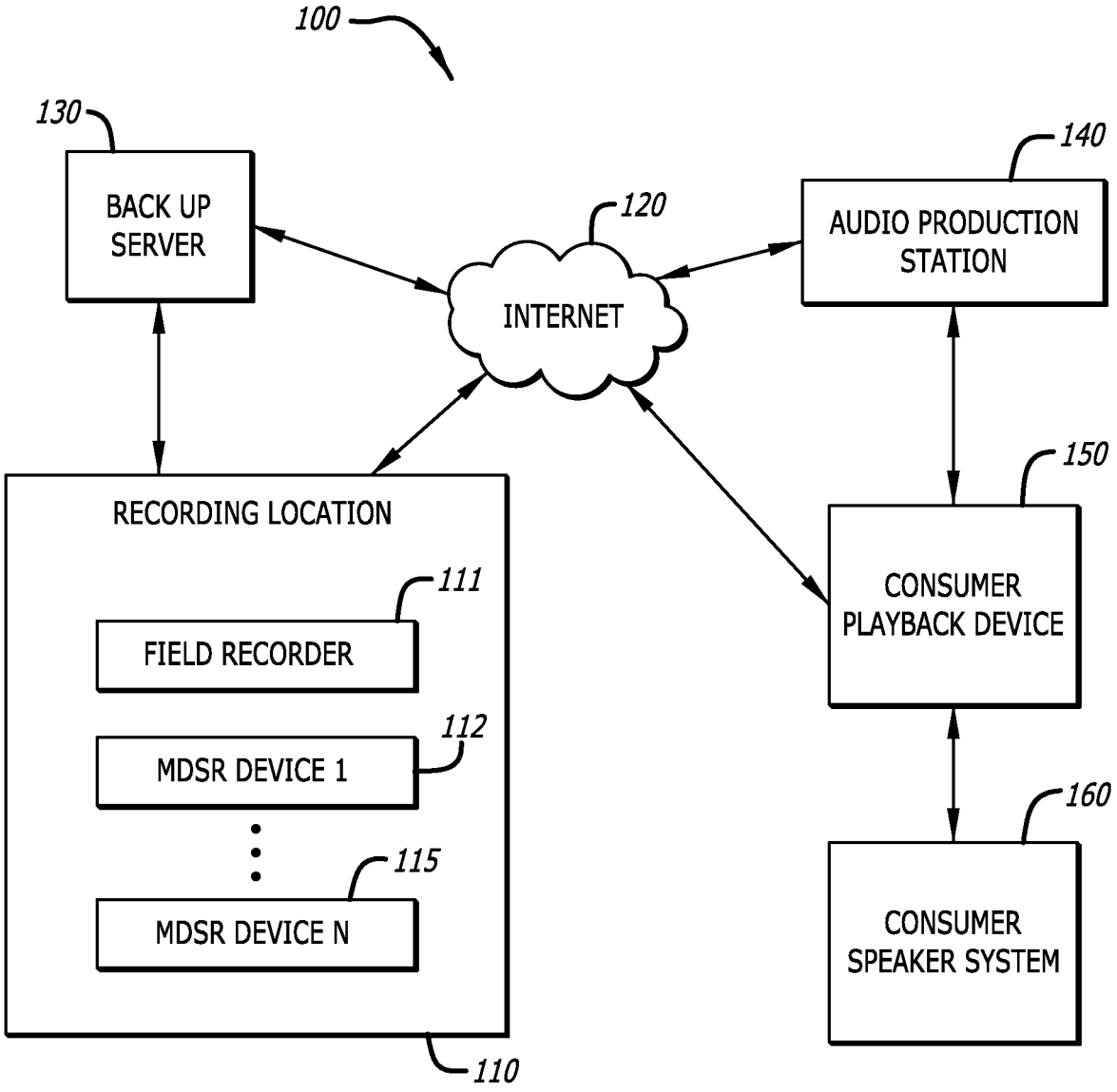
FIG. 1 is a system diagram of the multi-dimensional spatial recording system in accordance with an embodiment of the invention.

Corresponding reference characters indicate corresponding components throughout the several figures of the drawings. Elements in the several figures are illustrated for simplicity and clarity and have not necessarily been drawn to scale. For example, the dimensions of some of the elements in the figures might be emphasized relative to other elements for facilitating understanding of the various presently disclosed embodiments. In addition, common, but well-understood, elements that are useful or necessary in a commercially feasible embodiment are often not depicted in order to facilitate a less obstructed view of these various embodiments of the present disclosure.

DETAILED DESCRIPTION

Embodiments described herein teach systems and methods recording and generating multidimensional sound on various consumer playback devices. In the current state of the art, the mixing engineer often applies some kind of artificial reverberation to the sound signals, usually to reproduce the space in which the action was filmed. If the scene takes place inside a church, for example, the engineer will apply a church reverb effect to the sounds. The problem with this procedure is that these effects are fixed in the mix and do not take into account the space where the film will be played back later. Following the same example, if the film were shown inside a church, the dialogue of the scene would be almost unintelligible because of the effect of an artificial church added to the live sound of the venue. With this invention, the system can gather the original reverberation time and acoustic characteristics of the filming location; at the same time, the playback system gathers the same information of the room in which the film is being reproduced, and applies the acoustics, equalization, reverberation kind and time—all this it in real time—in a scene per scene basis.

In many embodiments of this disclosure, the system can along with the recording of the sound, record the location of the sound source relative to a three-dimensional space corresponding to the cinematographic frame and allows it to be manipulated and processed for the purpose of reconstructing the original spatial relations, during the final exhibition in cinemas and homes. In further embodiments, it may be able to produce versions in different languages, in such a way that the same spatial relations effects registered for the original voices can be automatically applied to these new voices. Finally, certain embodiments may be able to make these adjustments automatically, so that by entering information related to the acoustic characteristics of the recording site and the reproduction site, final adjustments can be applied and that the voices or sound sources reach the audience in its optimum quality and reflecting the intentions of the original sound design.

As part of the state of the art, vector algebra can be utilized to describe the way in which a series of calculations related to the location of the sound source with respect to several reference points. It can present a notation and operations that a person versed in the subject can recognize directly or with the help of textbooks.

Additional embodiments may utilize positioning systems that allow determining the position and orientation of an object in space. This information is called 6D information, since it controls 6 degrees of freedom of an object: three of position and three of orientation. The most precise systems (with an accuracy of approximately 3 centimeters), known as local or site positioning, are designed to work within a recording studio, a building or a delimited area, equipped with a series of sensors applied to the objects to be positioned and a series of base stations that triangulate their location and orientation.

Various embodiments of this disclosure consist of the capture and recording of the location (real time position) in three-dimensional space of an original sound source; it also consists of the capture and recording of the spatial information of the original location. This can involve processing that information during editing and mixing, to reconstruct or modify the original sound landscape. Finally, the processed information can be used to reproduce the sound in cinemas and homes in a three-dimensional (or two-dimensional for simplicity) way. The same position information can also be applied to new voices or audio recorded later as dubbing, so that the spatiality of the sound is maintained in the different versions or languages of the film. All of the above can be achieved automatically, reducing post-production costs and greatly improving the viewer's experience.

In many embodiments, this can also be a method to define a physical space by its acoustic characteristics, which can be incorporated into the process of recording used in the post production process and incorporated in its final distribution format, in order to faithfully reconstruct the original space in the room of the end exhibition.

Currently, the mixing engineer decides on how the space sounds, and where the audio character lives and is configured. Based on the acoustic characteristics of the desired space, audio effects such as reverberation, delays and echoes are applied to the signal to give a scene feeling which can be adjusted for locations such as, a cellar, a church or a small room. However, the effect desired by the engineer can vary considerably according to the characteristics of the space where the film is displayed. If the film is played in a warehouse, for example, a "warehouse" effect that was originally added will double and interfere with the understanding of the dialogue.

Embodiments of this disclosure solve this problem automatically, allowing us to establish the acoustic characteristics of the original space and those of the exhibition space, to then compensate one another and achieve a faithful reproduction in each particular exhibition space. The basis of this system is to determine and record in real time the location in the space of each microphone used, and the camera (to obtain what will then be the "point of view" of the viewer). This can be achieved in several different ways. There are currently systems that allow sensors and interconnected base stations to determine the position of an object in space.

In certain embodiments, each actor or microphone can be equipped with one position sensor and the camera with another. This will generate a flow of information for each sensor that will indicate its instantaneous position in three-dimensional space. Parallel to the traditional recording of the sound signal, for each microphone the signal collected by the base stations will also be recorded, consisting of X, Y, Z coordinates corresponding to the position of the microphone and the camera at each moment. We will call this information flow the Position information (iPos or spatial data).

In a traditional sound recorder, a dedicated channel can be added to record this iPos data as a converted audio format signal. Thus, the sound signal (dialogs) and the iPos (position of the actor and the camera) can be recorded at the same time. In some embodiments, a separate recording device can be set up to record this iPos data, as long as it is synchronized via a time code or other synchronization signal with the sound recorder. During the sound postproduction process (editing and mixing) the engineer can apply this spatial information iPos data to the sound signal and reproduce the same movements of the original scene within the reproduction space (the cinema or the spectator's room).

The great advantage of this system is that the sound moves in an identical way to the original movement, without having to go through the traditional manual "panning" (panoramic manipulation) or manual location in space. This process can therefore be done automatically by means of applying the iPos data to the sound signal. Once the mix of the original version of the film is finished, dubbing can be used, for example, to produce additional versions in different languages. The information of iPos spatial data can be applied to these new tracks to obtain the same sensation of movement in the different versions, automatically.

It is important to point out that the number of base stations utilized to capture and generate spatial data can vary. For example, if a system with vertical precision is needed, then you can use eight stations to precisely map the vertical axis. Or, by using three sensors per sound source and in the camera, you can reduce the whole system to a single base station, allowing for easy calculations of the exact position, and aiming of each sound source. This can enable the possibility to apply the orientation information to modify the final result, hence reproducing the actors aiming while he speaks.

Based on this system, it is perfectly possible to reduce the number of speakers in a playback environment currently used, from five to four (plus the subwoofer for low frequency), since the central channel, where until now the voice channel is exclusively located, would no longer be necessary.

It is important to understand that the base stations or other devices utilizing spatial capturing software that gather information from the sensors do not necessarily have to be in the four corners of the recording space. Actually, they can be located anywhere in the space, as long as they can pick up the position information of the microphones, and by means of software, decide the dimensions of the space afterwards. This is particularly relevant since it allows to recreate virtual filming spaces, as in the cases in which the film is shot in studio against a blue/green screen or when the whole film is animated.

Since the location space can be also determined artificially, the system can be applied in the same way to virtual spaces, like those of 3D animations. In the same way and through the same manipulation by software, the speakers in the reproduction space do not necessarily have to be correctly positioned. By collecting acoustic information from the room, acoustic imperfections can be corrected or different spaces recreated.

In addition to collecting the iPos spatial data of each microphone and the camera, the base stations can collect the basic information that determines the acoustic qualities of the location: dimensions, proportions and reverberation time per frequency band. In effect, we understand that the particular sound profile of a given space depends on its dimensions, proportions and reverberation time. By collecting this information in each location, it can be applied during playback in the spectator's room.

But thanks to the fact that the acoustic information of the location was collected in the first moment, it may be easy to keep it within the distribution format of the film, as an acoustic information channel. A new channel with this information can be added to the channels that contain the sound signals. As part of the exhibition sound systems, theatres or houses, sensors capable of collecting the acoustic information of the exhibition hall may be used. Using various data processing methods, you can apply the exact reverb for each scene, to reconstruct the original acoustic information in that particular exhibition space.

These embodiments can allow for reconstruction of the distance between the actor and the camera in a precise way, which supports the desire to faithfully reproduce the feeling of distance between the character on the screen and the spectator.

The description herein is not to be taken in a limiting sense, but is made merely for the purpose of describing the general principles of exemplary embodiments. The scope of the disclosure should be determined with reference to the claims. Reference throughout this specification to "one embodiment," "an embodiment," or similar language means that a particular feature, structure, or characteristic that is described in connection with the referenced embodiment is included in at least the referenced embodiment. Likewise, reference throughout this specification to "some embodiments" or similar language means that particular features, structures, or characteristics that are described in connection with the referenced embodiments are included in at least the referenced embodiments. Thus, appearances of the phrases "in one embodiment," "in an embodiment," "in some embodiments," and similar language throughout this specification can, but do not necessarily, all refer to the same embodiment.

Further, the described features, structures, or characteristics of the present disclosure can be combined in any suitable manner in one or more embodiments. In the description, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth. In other instances, well-known structures, materials, or operations are not shown or described in detail to avoid obscuring aspects of the present disclosure.

In the following description, certain terminology is used to describe features of the invention. For example, in certain situations, both terms "logic" and "engine" are representative of hardware, firmware and/or software that is configured to perform one or more functions. As hardware, logic (or engine) may include circuitry having data processing or storage functionality. Examples of such circuitry may include, but are not limited or restricted to a microprocessor, one or more processor cores, a programmable gate array, a microcontroller, a controller, an application specific integrated circuit, wireless receiver, transmitter and/or transceiver circuitry, semiconductor memory, or combinatorial logic.

Logic may be software in the form of one or more software modules, such as executable code in the form of an executable application, an application programming interface (API), a subroutine, a function, a procedure, an applet, a servlet, a routine, source code, object code, a shared library/dynamic link library, or one or more instructions. These software modules may be stored in any type of a suitable non-transitory storage medium, or transitory storage medium (e.g., electrical, optical, acoustical or other form of propagated signals such as carrier waves, infrared signals, or digital signals). Examples of non-transitory storage medium may include, but are not limited or restricted to a programmable circuit; a semiconductor memory; non-persistent storage such as volatile memory (e.g., any type of random access memory "RAM"); persistent storage such as nonvolatile memory (e.g., read-only memory "ROM", power-backed RAM, flash memory, phase-change memory, etc.), a solid-state drive, hard disk drive, an optical disc drive, or a portable memory device. As firmware, the executable code is stored in persistent storage.

The term "processing" may include launching a mobile application wherein launching should be interpreted as placing the mobile application in an open state and performing simulations of actions typical of human interactions with the mobile application. For example, the mobile application, FACEBOOK®, may be processed such that the mobile application is opened and actions such as user authentication, selecting to view a profile, scrolling through a newsfeed, and selecting and activating a link from the newsfeed are performed.

The term "application" should be construed as a logic, software, or electronically executable instructions comprising a module, the application being downloadable and installable on a network device. An application may be a software application that is specifically designed to run on an operating system for a network device. Additionally, an application may be configured to operate on a mobile device and/or provide a graphical user interface (GUI) for the user of the network device.

The term "network device" should be construed as any electronic device with the capability of connecting to a network, downloading and installing mobile applications. Such a network may be a public network such as the Internet or a private network such as a wireless data telecommunication network, wide area network, a type of local area network (LAN), or a combination of networks. Examples of a network device may include, but are not limited or restricted to, a laptop, a mobile phone, a tablet, etc. Herein, the terms "network device," "endpoint device," and "mobile device" will be used interchangeably. The terms "mobile application" and "application" should be interpreted as logic, software or other electronically executable instructions developed to run specifically on a mobile network device.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Referring to FIG. 1, a system diagram of the multi-dimensional spatial recording ("MDSR") system 100 in accordance with an embodiment of the invention is shown. The MDSR system 100 can be configured to record multi-dimensional sound at a recording location 110 which can then be processed and delivered to a consumer playback device 150 which can generate multi-dimensional sound via a consumer speaker system 160. In many embodiments, the MDSR system 100 can deliver multi-dimensional sound via a network such as the Internet 120.

While certain embodiments of the MDSR system 100 can deliver multi-dimensional audio directly to a consumer-level device such as a consumer playback device 150, further embodiments may deliver multi-dimensional audio recordings to one or more audio production stations 140. An audio production station 140 can mix, master, or otherwise process the received multi-dimensional audio for use in products configured for use in one or more consumer playback devices 150.

In a variety of embodiments, the recording location 110 can produce multi-dimensional audio via a plurality of MDSR devices 112, 115 that can be configured to record spatial audio data that can be recorded to a field recorder 111. The field recorder 111 can be a standard multi-track audio recorder with one or more tracks dedicated to recording spatial data formatted to be compatible with the field recorder 111. In many embodiments, the field recorder 111 can be a dedicated device configured to record native audio and spatial data generated by the plurality of MDSR devices 112, 115.

In a variety of embodiments, one or more backup servers 130 can be configured to provide a backup or remote storage of the multi-dimensional audio data recorded at the recording location 130. This may be configured as a safeguard against data loss, or as a means of providing increased recording time for applications that require increased data use and may not have sufficient storage at the recording location 110 (e.g. a remote location). The backup server 130 may be provided and/or administered by a third-party company such as a cloud-based service provider.

Figure 2A:
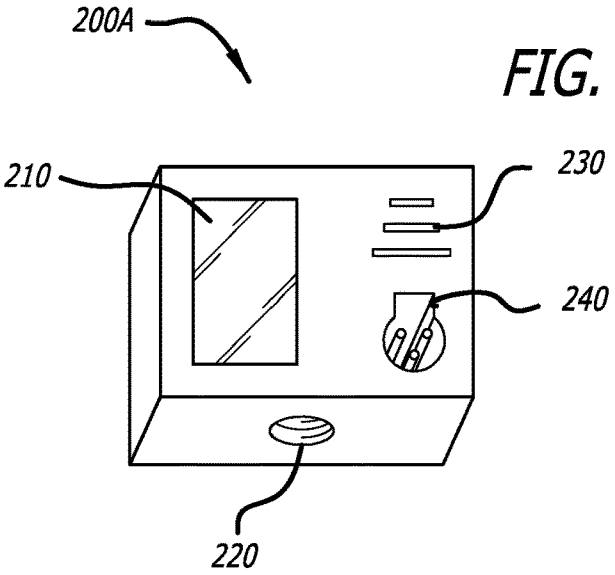
FIG. 2A is a conceptual illustration of a room multi-dimensional spatial recording device in accordance with an embodiment of the invention.

Referring to FIG. 2A, a conceptual illustration of a room multi-dimensional spatial recording device 200A in accordance with an embodiment of the invention is shown. In many embodiments, multi-dimensional spatial data can be recorded via a room MDSR device 200A. As shown in more detail in FIGS. 3B and 3C, the room MDSR device 200A can be configured to record data in a two-dimensional or three-dimensional plane.

In a number of embodiments, the room MDSR device 200A is configured with a threaded cavity 220 suitable for coupling with a threaded protrusion such as a stand or other positioning device. The room MDSR device 200A can obtain audio recordings from either an internal microphone 230 or via one or more external microphone inputs 240. Although shown in FIGS. 2A-2C as a standard external line return ("XLR") input 230, 231, 232, the MDSR devices can be configured with any number or types of audio inputs such as, but not limited to, ¼ inch, ⅛ inch, RF receiver, and/or Bluetooth® connections.

The room MDSR device 200A is also equipped with one or more sensors arrays 210 for generation of spatial data. The spatial data can be generated by recording positional data within the scene being recorded. Positional data can be recorded via the sensor arrays 210 based on the types of sensors provided within the MDSR device 200A. It is contemplated that the sensor array 210 can be configured with one or more combinations of sensors depending on the application desired.

For example, certain room MDSR devices 200A may be utilized on a fully virtual chromakey recording location which can (for example) consist of green screen actors, backgrounds, or other props. In these instances, the sensor array 210 can be configured with one or more tracking cameras which may track objects, chroma data, and/or tracking units (such as motion capture points) within the scene. This type of positional data can be processed to determine spatial data associated with one or more actors, props, or other items within a recording location. In these environments, embodiments are contemplated that utilize an artificially generated acoustical footprint that can match the environment that will be added in post-production processes.

In another embodiment, the sensor arrays 210 can include one or more depth cameras which may record depth related to item within the scene from the perspective of the room MDSR device 210A. Depth data may be processed within the device and stored as spatial data. However, in a number of embodiments, the raw depth data may be stored to the field recorder which then processes the recorded data to determine the spatial data. However, in additional embodiments, the recorded data is sent to an audio production station which may further process the data to generate spatial data that can be utilized to mix, master, or process into data suitable for playback on consumer devices.

Furthermore, in many applications, acoustical footprint data will need to be recorded in order to provide one or more background/backing ambiance tracks. These tracks are typically desired to be recorded via the internal microphone 230 to better replicate a multi-dimensional audio experience after processing. Acoustical footprint data can be stored as part of a special track within the field recorder or as a unique metadata or other data structure within the spatial data.

Finally, most embodiments of the instant application record multi-dimensional spatial data via one or more room MDSR devices 200A. In these embodiments, there can often be a method to synchronize the plurality of room MDSR devices 200A to properly communicate and record data to the field recorder. Certain embodiments may provide for a hard-wired connection between the room MDSR devices 200A and the field recorder. In further embodiments, the connection between the field recorder and the plurality of MDSR devices 200A can be wireless including, but not limited to Wi-Fi, Bluetooth®, and/or a proprietary wireless communication protocol.

Figure 2B:
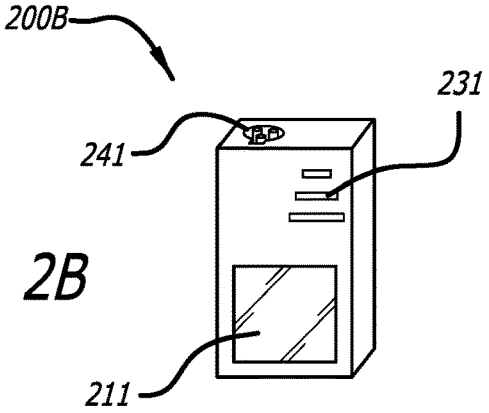
FIG. 2B is a conceptual illustration of a personal multi-dimensional spatial recording device in accordance with an embodiment of the invention.

Referring to FIG. 2B, a conceptual illustration of a personal multi-dimensional spatial recording device 200B in accordance with an embodiment of the invention is shown. Similar to the room MDSR device 200A of FIG. 2A, the personal MDSR device 200B is configured with an internal microphone 231, external audio input 200B, and one or more sensor arrays 211. These embodiments are often configured to be compact and suitable for wearing by one or more actors within the scene being recorded at the recording location.

In certain embodiments, the personal MDSR device 200B can be configured with a global positioning system ("GPS") tracking system that can be utilized to generate spatial data. In additional embodiments, the personal MDSR device 200B can further communicate and generate spatial data by triangulating signals communicated between a plurality of sensors or other reference signals in the recording location. Reference signals can also be generated by room MDSR devices 200A that are previously positioned within the recording location.

Figure 2C:
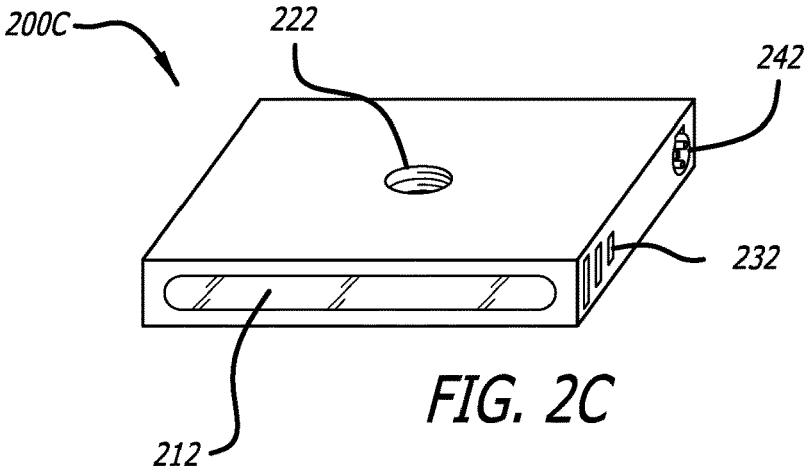
FIG. 2C is a conceptual illustration of a camera-based multi-dimensional spatial recording device in accordance with an embodiment of the invention.

Referring to FIG. 2C, a conceptual illustration of a camera-based multi-dimensional spatial recording device 200C in accordance with an embodiment of the invention is shown. In certain recording situations, it may be desired to dynamically move the camera throughout the recording scene within the recording location. In these embodiments, the camera can be fit with a camera-based MDSR device 200C. Similar to the room MDSR device 200A and the personal MDSR device 200B, the camera-based MDSR device 200C can be configured with an internal audio input 232, external audio input 242, and a sensor array 212.

Although, the camera-based MDSR device 200C is depicted with a threaded cavity 222 that can be configured for attachment to a camera, the method of attachment to the camera can occur in any suitable fashion based on the camera and/or accessories used within the recording location. In further embodiments, the camera-based MDSR device 200C can be utilized without being directly and/or physically attached to the camera.

Figure 3A:
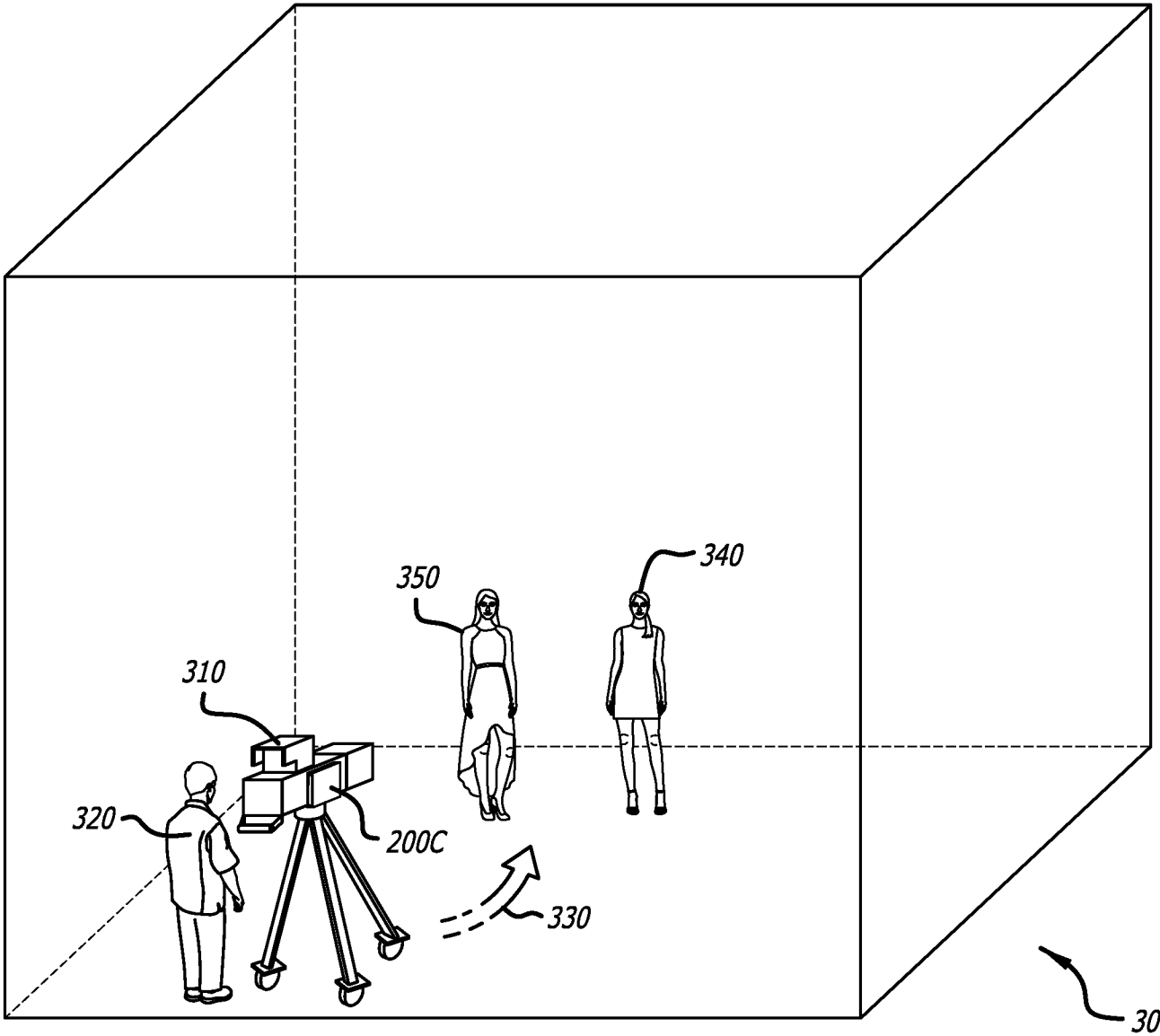
FIG. 3A is a conceptual illustration of a multi-dimensional spatial recording environment with a dynamically moving camera in accordance with an embodiment of the invention.

Referring to FIG. 3A, a conceptual illustration of a multi-dimensional spatial recording environment with a dynamically moving camera in accordance with an embodiment of the invention is shown. In various embodiments, a scene being recording within a recording location 300 may require a camera 310 equipped with a camera-based MDSR device 200C to dynamically move 330 throughout the recording location 300. Typically, the dynamic movement 330 is achieved by moving the camera 310 by a cameraman 320. In various embodiments, the camera-based MDSR device 200C can track multiple subjects 340, 350 within the recording location 300.

By tracking the subjects 340, 350, the movement of the camera 310, and other signals within the recording location 300, raw positional data may be recorded by the camera-based MDSR device 200C. The positional data can be combined and processed to yield spatial data either at the recording location 300 or transmitted to a remote processing device or server as needed.

Figure 3B:
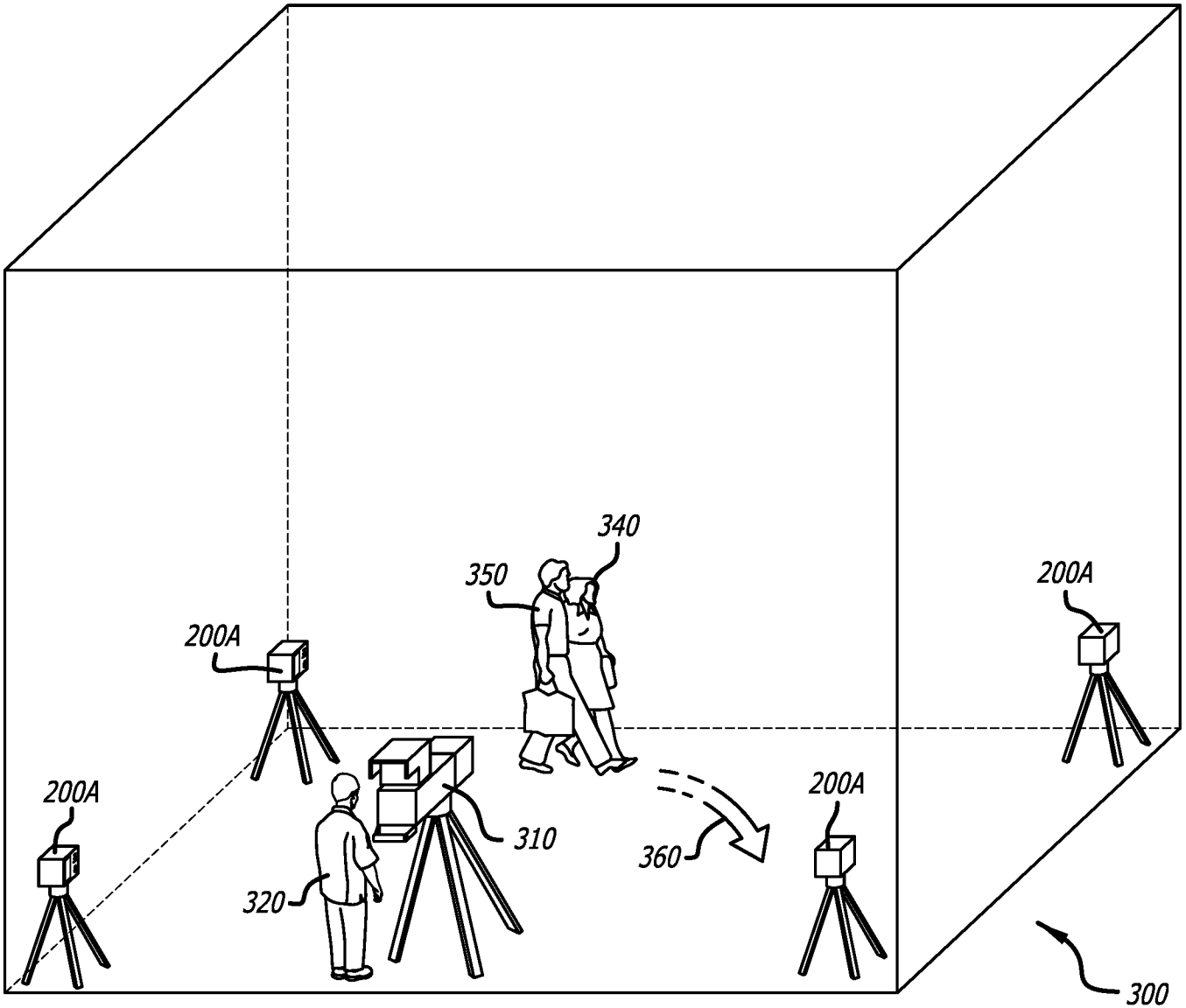
FIG. 3B is a conceptual illustration of a multi-dimensional spatial recording environment with two-dimensional movement recording in accordance with an embodiment of the invention.

Referring to FIG. 3B, a conceptual illustration of a multi-dimensional spatial recording environment with two-dimensional movement recording in accordance with an embodiment of the invention is shown. In certain recording locations 300, the scene to be recorded involves one or more subjects 340, 350 who are dynamically moving 360 during recording while the camera 310 is operated by a cameraman 320 in a stationary or fixed position (while allowing for traditional panning). In many embodiments, the capture of multi-dimensional spatial data can be achieved by limiting the recording to a single plane of focus.

In the embodiment depicted in FIG. 3B, the recording location 300 is comprised of a plurality of room MDSR devices 200A that are positioned at the corners of the recording location 300. In order to better capture a plane of interest, the plurality of room MDSR devices 200A can be elevated by one or more stands or other fixtures as needed. In this way, differences in the captured sound between the various room MDSR devices 200A can be utilized to generate spatial data which can help with subsequent audio mixing later on. Room MDSR devices 200A can also utilize depth cameras and/or other sensors to generate positional data associated with the subjects 340, 350 during movement 360 within the recording location 300.

In further embodiments, the MDSR devices 200A are configured to receive signals by a plurality of multi-dimensional sound recording sensors that can be placed on the camera 310 and actors 340, 350 within the recording location 300. In certain embodiments, the sensors may be placed or attached to each microphone in the recording location 300. These sensors may generate a wireless signal that can be captured by the MDSR devices 200A and converted via a triangulation to positional data within the recording location 300. This positional data may correspond to the position of the sensor within a two-axis plane within the recording location 300. As shown below, particular embodiments may be configured to allow for the recording of a three-axis position within the recording location 300.

This positional data can be formatted as an audio signal that can be subsequently recorded onto an audio recording channel within a field recorder or other location audio recorder. In some embodiments, the positional data is combined to generate spatial data of the entire scene which may also be formatted and stored as an audio signal. In still more embodiments, positional data may be stored individually within each MDSR device 200A, meaning that triangulation cannot occur until all positional data is combined into spatial data which may then process the combined positional data to triangulate the position of the one or more sensors within the recording location 300 over a period of time within the recording.

Figure 3C:
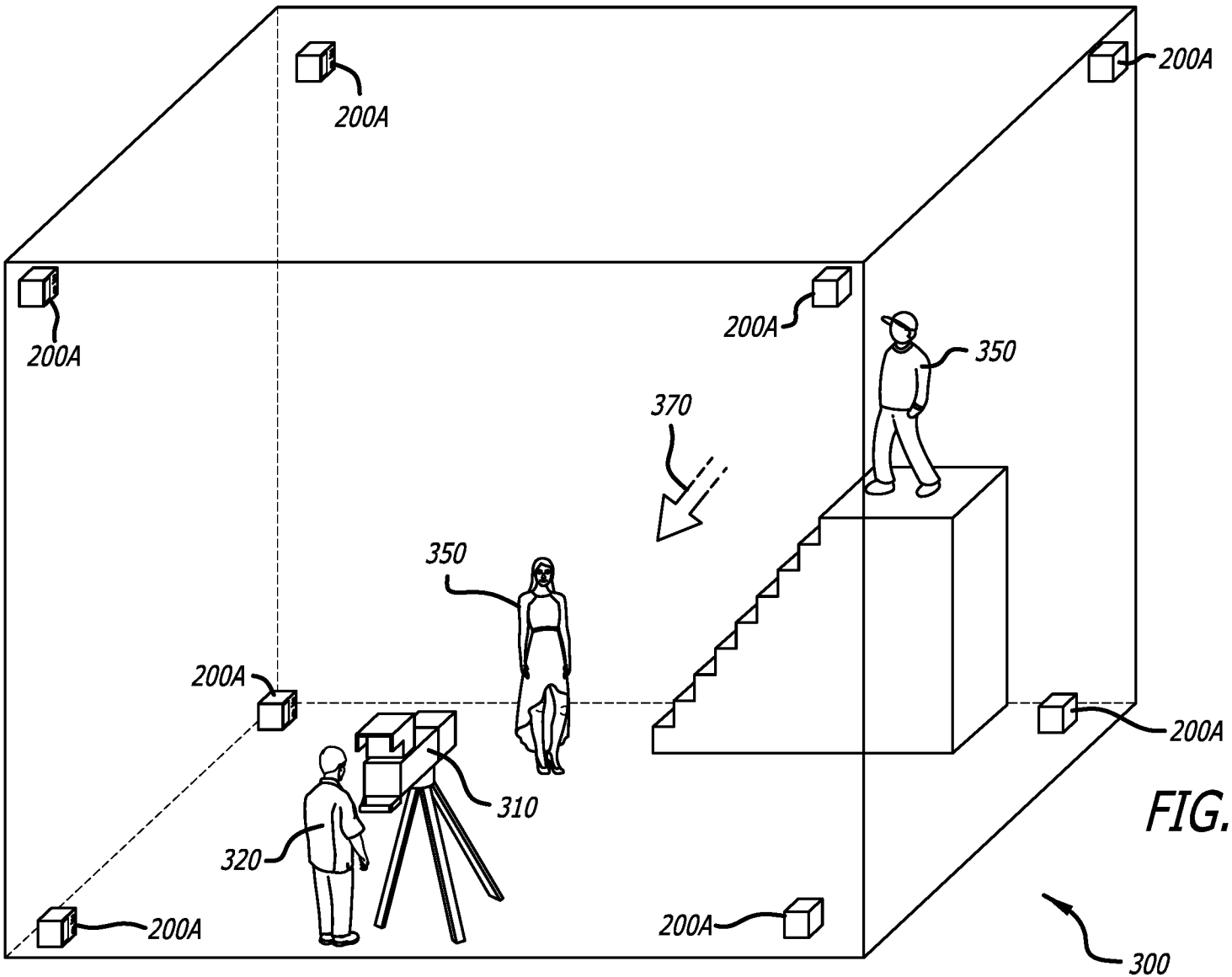
FIG. 3C is a conceptual illustration of a multi-dimensional spatial recording environment with three-dimensional movement recording in accordance with an embodiment of the invention.

Referring to FIG. 3C, a conceptual illustration of a multi-dimensional spatial recording environment with three-dimensional movement recording in accordance with an embodiment of the invention is shown. Similar to the embodiment depicted in FIG. 3B, the recording location 300 depicted in the embodiment of FIG. 3C comprises a pair of subjects 350, 360 who are dynamically moving 370 throughout the scene. However, unlike the movement 360 in FIG. 3B, the dynamic movement 370 is done through multiple dimensions. In order to best record positional data that can be utilized to generate spatial data, a plurality of room MDSR deices 200A are positioned at the upper and lower corners of the recording location 300.

Similar to the embodiment depicted in the discussion of FIG. 3B, the differences in audio recorded by each of the plurality of room MDSR devices 200A can be utilized to generate positional data and triangulate the positions of the subjects 350, 360 within the recording location 300. It is contemplated that, as discussed above, other sensors such as depth cameras and/or motion tracking components may be utilized to track the subjects 350, 360 during recording. In various embodiments, the camera 310 is stationary, but may also be equipped with a camera-based MDSR device 200C which can track the camera 310 if it is moved throughout the recording location 300 by the cameraman 320.

As will be understood by those skilled in the art, the embodiments and recording locations 300 depicted in FIGS. 3A-3C are illustrative and not restrictive. Indeed, any number of recording location sizes and shapes may be used. Any number of subjects may be included and may move anywhere throughout the scene. Cameras may be traditional stationary cameras, or may be on rigs, tracks, motion stabilizer systems, or worn by a cameraman, drone, or other remote operating device. It is contemplated that any combination of MDSR device may be utilized as needed to best track the desired subjects within a recording location. Other shapes and positionings of the MDSR devices may be utilized in response to desired applications, and/or increased technological capacity.

Figure 4:
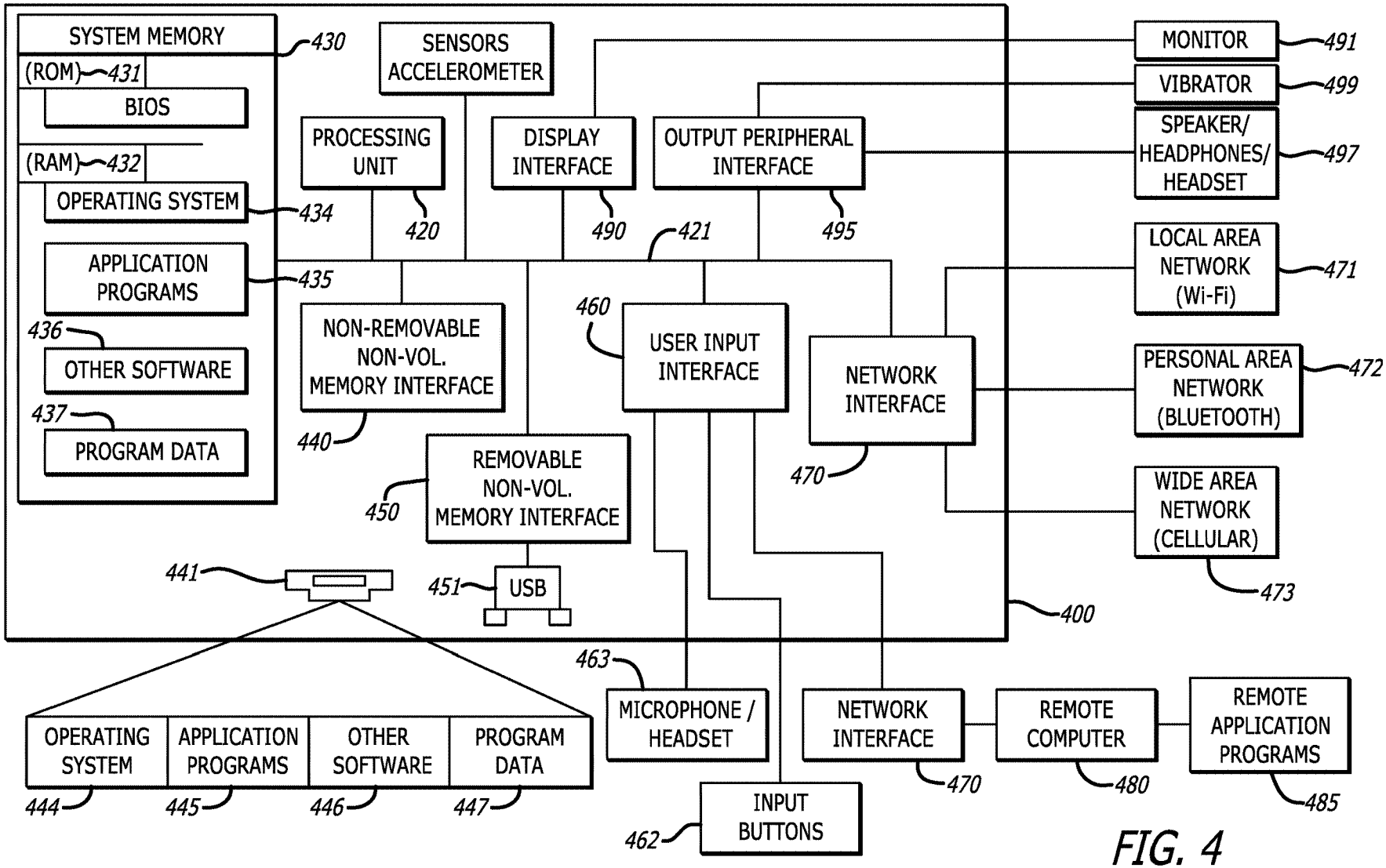
FIG. 4 is a conceptual schematic illustration of various components within a multi-dimensional spatial recording device in accordance with an embodiment of the invention.

Referring to FIG. 4, a conceptual schematic illustration of various components within a multi-dimensional spatial recording device in accordance with an embodiment of the invention; is shown. Components of the multi-dimensional spatial recording device 400 can include, but are not limited to, a processing unit 420 having one or more processing cores, a system memory 430, and a system bus 421 that couples various system components including the system memory 430 to the processing unit 420. Further components can include a user input interface 460, display interface 490, a monitor 491, output peripheral interface 495, speaker/headphone/headset 497, and/or vibrator 499. The system bus 421 can be any of several types of bus structures selected from a memory bus or memory controller, a peripheral bus, and a local bus using any of a variety of bus architectures. It is contemplated that various embodiments of the multi-dimensional spatial recording device may be realized within a mobile computing device as one or more software applications.

The multi-dimensional spatial recording device 400 can include computing machine-readable media. The computing machine-readable media can be any available media that can be accessed by the multi-dimensional spatial recording device 400 and includes both volatile and non-volatile media, along with removable and non-removable media. By way of example and not limitation, computing machine-readable media includes storage of information, such as computer-readable instructions, data structures, other executable software or other data. The computing machine-readable media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other tangible medium that can be used to store the desired information and that can be accessed by the multi-dimensional spatial recording device 400. Transitory media such as wireless channels are not included in the computing machine-readable media. Communication media typically embody computer-readable instructions, data structures, other executable software, or other transport mechanisms and include any information delivery media. As an example, some multi-dimensional spatial recording devices 400 on a network might not have optical or magnetic storage.

The system memory 430 can include computing machine-readable media in the form of volatile and/or non-volatile memory such as read-only memory (ROM) 431 and random access memory (RAM) 432. A basic input/output system 433 (BIOS) containing basic routines configured for transferring information between elements within the multi-dimensional spatial recording device 400, such as during start-up, can be stored in the ROM 431. The RAM 432 can contain data and/or software immediately accessible to and/or presently being operated on by the processing unit 420. By way of example, and not limitation, FIG. 4 illustrates that the RAM 432 can include a portion of the operating system 434, the application programs 435, and other software 436.

The multi-dimensional spatial recording device 400 can also include other removable/non-removable volatile/non-volatile computing machine-readable media. By way of example only, FIG. 4 illustrates a solid-state memory 441. Other removable/non-removable, volatile/nonvolatile computing machine-readable media that can be used in the example operating environment include, but are not limited to, USB drives and devices, flash memory cards, solid-state RAM, solid-state ROM, and the like. The solid-state memory 441 can be connected to the system bus 421 through a non-removable memory interface such as interface 440, and the USB drive 451 can be connected to the system bus 421 by a removable memory interface, such as interface 450.

The drives and their associated computing machine-readable media discussed above and illustrated in FIG. 4 provide storage of computer-readable instructions, data structures, other executable software and other data for the multi-dimensional spatial recording device 400. In FIG. 4, for example, the solid-state memory 441 is illustrated for storing operating system 444, application programs 445, other executable software 446, and program data 447. Note that these components can either be the same as or different from the operating system 434, the application programs 435, and other software 436. The operating system 444, the application programs 445, the other executable software 446, and the program data 447 are given different numbers here to illustrate that, at a minimum, that they can be different copies.

A user (e.g., a parent, network administrator, etc.) can enter commands and information into the multi-dimensional spatial recording device 400 through input devices such as a keyboard, a touchscreen, software or hardware input buttons 462, a microphone 463, or a pointing device or scrolling input component such as a mouse, trackball, or touch pad. This input can be done directly on a multi-dimensional spatial recording device 400 or can be entered gathered from the Internet via social media databases and transmitted directly as input to the multi-dimensional spatial recording device 400.

The multi-dimensional spatial recording device 400 can operate in a networked environment using logical connections to one or more remote computers/client devices, such as a remote computing system 480. The remote computing system 480 can be a cloud-based server, a personal computer, a hand-held device, a router, a peer device or other common network node, and can include many or all of the elements described above relative to the multi-dimensional spatial recording device 400. The logical connections depicted in FIG. 4 can include a personal area network ("PAN") 472 (e.g., Bluetooth®), a local area network ("LAN") 471 (e.g., Wi-Fi), and a wide area network ("WAN") 473 (e.g., cellular network), but the logical connections can also include other networks. Such networking environments can be found in offices, enterprise-wide computer networks, intranets and the Internet. A browser application can be resident on the computing device and stored in the memory.

When used in a LAN networking environment, the multi-dimensional spatial recording device 400 can be connected to the LAN 471 through a network interface or adapter 470, which can be, for example, a Wi-Fi adapter. When used in a WAN networking environment (e.g., Internet), the multi-dimensional spatial recording device 400 typically includes some means for establishing communications over the WAN 473 such as the network interface 470. With respect to mobile telecommunication technologies, for example, a radio interface, which can be internal or external, can be connected to the system bus 421 via the network interface 470, or some other appropriate mechanism. In a networked environment, other software depicted relative to the multi-dimensional spatial recording device 400, or portions thereof, can be stored in a remote memory storage device. By way of example, and not limitation, FIG. 4 illustrates remote application programs 485 as residing on a remote computing device 480. It will be appreciated that the network connections shown are examples and other means of establishing a communications link between the computing devices can be used.

Figure 5:
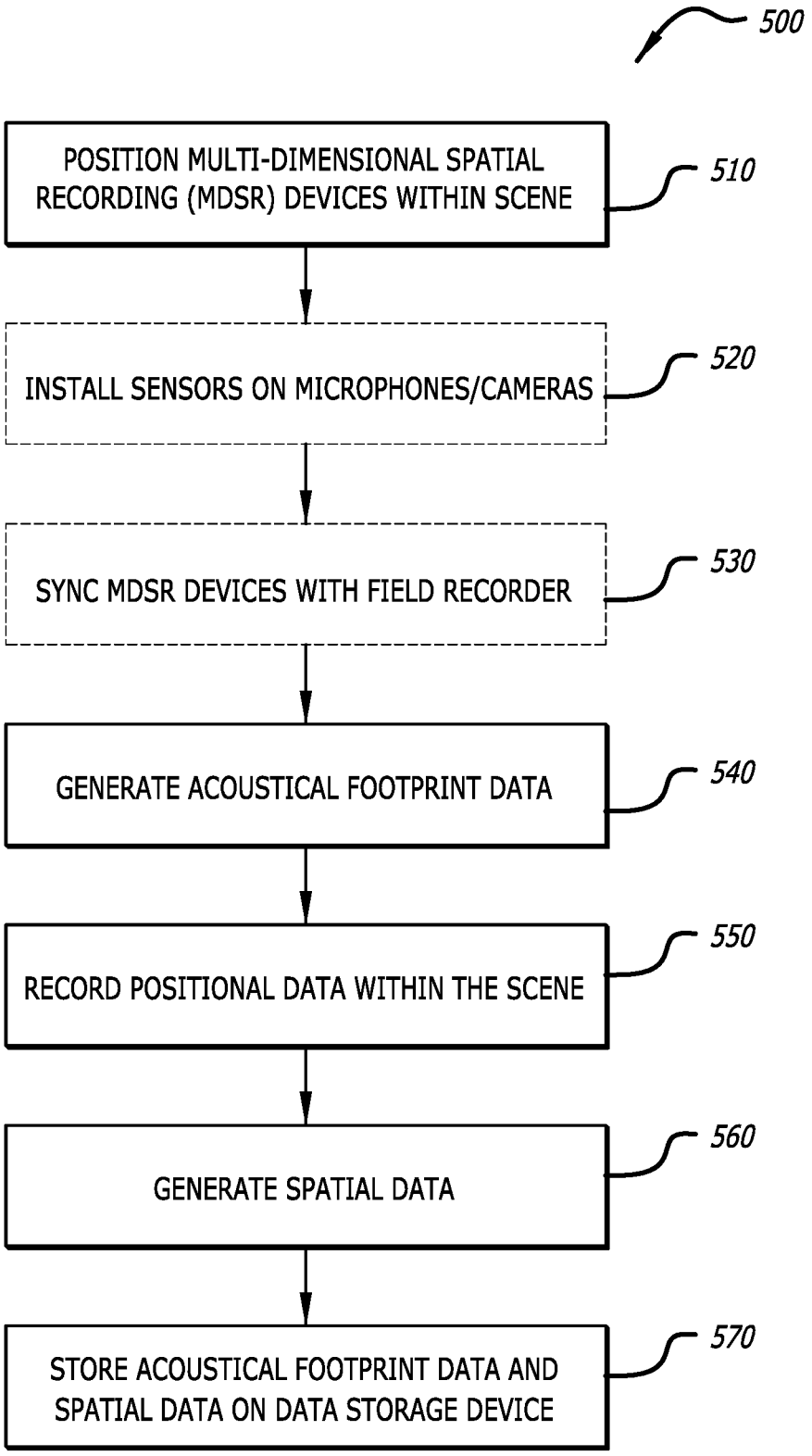
FIG. 5 is a flowchart depicting a process for generation spatial data for use within a multi-dimensional spatial recording system in accordance with embodiments of the invention.

Referring to FIG. 5, a flowchart depicting a process 500 for generation spatial data for use within a multi-dimensional spatial recording system in accordance with embodiments of the invention is shown. In many embodiments, the MDSR devices are positioned within a scene based on the desired application (block 510). As discussed above with respect to FIGS. 3A-3C, the selection of the different types of MDSR devices, and their placement within the scene can vary based on various elements included the projected movement within the scene, the number of subjects to record, and/or the shape of the recording location.

In certain embodiments, the MDSR devices can be equipped to provide recoding from microphones or sensors that are not natively within the MDSR device. For example, one or more MDSR devices may be not be able to be placed in a desired location (perhaps due to aesthetic or composition reasons), while an external microphone input on the MDSR device may allow for the placement of a microphone where the MDSR device would optimally be positioned (block 520). Similar accommodations can be made for other sensors and/or can be equipped on devices to supplement their native sensors.

In most embodiments, the MDSR devices do not record internally, but transmit their data to a dedicated field recording device. As discussed above, the field recording device can be a standard field recorder that records data that has been formatted to be compatible with the field recorder. In other embodiments, the field recorder is a specialized device that is configured to record the data received from a plurality of MDSR devices. Typically, in many embodiments, the plurality of MDSR devices must be paired or otherwise synced with the field recorder prior to recording (block 530).

Prior to the start of recording, the process 500 can record ambient sounds that can be utilized to generate acoustical footprint data that can be helpful in later mixing applications (block 540). Unlike typical background ambient audio tracks, acoustical footprint data may be more complex and include multiple tracks of ambient audio along with positional data generated from the MDSR devices. In this way, the ambient tracks can be generated not just on the position of a single microphone location as in standard ambient noise tracks but may be mixed as to simulate ambient noise at one or more locations within the recording location.

During the recording of a scene, the plurality of MDSR devices record audio and sensor data. This raw input data can be processed to generate raw positional data within the MDSR devices (block 550). Positional data can be raw input data that is related solely to data received by each MDSR device. Positional data can be formatted to include any available data based on the type of recording sensors are available. For example, positional data may include the location of the MDSR device within a scene, which can change such as with personal MDSR devices 200B (FIG. 2B). Positional data may also include orientation of the MDSR device, as well as other metadata that may be useful for later use such as, but not limited to, orientation of the MDSR device, types of microphones and sensors used, altitude, light exposure, storage space, etc.

While positional data relates to data captured at the individual MDSR device level, each MDSR device within a scene recording can be gathered, processed, and synthesized into spatial data (block 560). Spatial data, as discussed above, can be processed and generated within the field recorder, or may be processed at a back-end server, or within a device or software utilized at the mixing/post-processing stage of the production. In certain embodiments, the spatial data may be generated at a consumer level device which can then be processed and manipulated by a consumer during playback of the recording.

At some point, the spatial data and acoustical footprint data is stored on a storage device (block 570). Typically, this is within a field recorder within the recording location. In some embodiments, the acoustical footprint data may be formatted such that it is contained within a more generalized spatial data structure. It is contemplated that a variety of data storage methods may be utilized, as discussed above in the various embodiments of FIG. 4.

Figure 6:
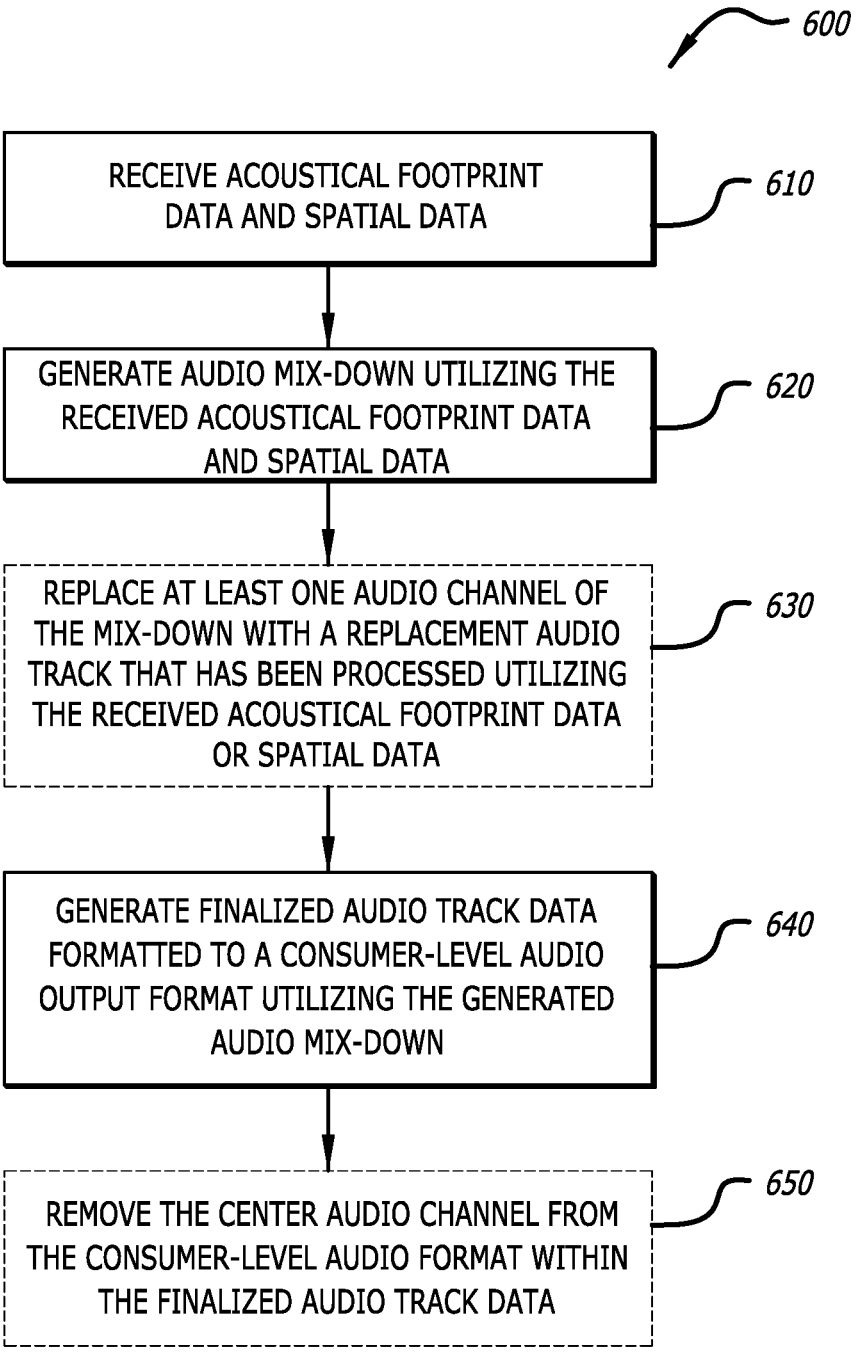
FIG. 6 is a flowchart depicting a process for generating audio track data based on spatial data in accordance with an embodiment of the invention.

Referring to FIG. 6, a flowchart depicting a process 600 for generating audio track data based on spatial data in accordance with an embodiment of the invention is shown. In many embodiments, once the acoustical footprint data and/or spatial data have been recorded, it may be utilized to generate one or more audio tracks for consumer-level products. In further embodiments, the consumer may be provided a means for manipulating the spatial data associated with a recording on their own device.

Once the acoustical footprint data and/or spatial data has been received at a destination device, the process 600 can further process the data based on the desired application (block 610). In a number of embodiments, a post-production environment may be utilized to generate audio mix-down data/audio tracks utilizing the received acoustical footprint data and/or the spatial data (block 620). This can be done via mixing software that includes a specialized plug-in, or via a proprietary application. In additional embodiments, a consumer-level device may be configured to generate unique audio mixes based on the received data (as well as user input in certain cases).

In various embodiments, audio mix-downs and/or other uniquely generated audio tracks can be achieved by replacing at least one audio channel of a pre-existing mix-down with a replacement audio track that has been processed utilizing the received acoustical footprint data and/or spatial data (block 630). These embodiments may, for example contain more specialized recordings of subject vocals within the recorded scene that better track with the locations of the subjects and/or cameras within the scene. By utilizing these embodiments, the removal of one or more channels may be possible due to a more accurate tracking of items within the original recording environment.

Once completed, finalized audio track data utilizing the generated audio mix-down may be generated which is formatted for use by a consumer-level audio output format (block 640). In many embodiments, the recording is desired to be played back on one or more consumer-level devices which are configured to accept a limited number of formats. The process 600 can then facilitate the generation of a compatible format of audio track data for playback on these consumer-level devices which were derived, at least in part, based on the received acoustical footprint data and/or spatial data. The generation of this compatible format of audio track data can be enhanced by utilizing playback data of the playback environment. This may be done via an acoustically generated scan (wherein the playback devices emit a sound, records the sound on an internal microphone, and processes the emitted sound to generate a playback area profile of the playback area). In some embodiments, the playback device may prompt the user for playback area information that can be generalized (is playback occurring in a large auditorium, living room, theater?) or specific (enter in room dimensions) which can aide in the generation of a playback area profile. This profile can then be utilized to modify the multi-dimensional sound recordings such as the finalized audio track data. In this way, audio playback may be dynamically individualized to the playback environment.

It is contemplated that various embodiments may utilizes these generate audio tracks to remove the center channel of audio from the consumer-level audio format (block 650). As discussed above, many recordings may be limited to keeping the spoken dialogue within a recorded scene to a center channel of a multiple-channel system. In this way, no matter where the subjects are in the scene, the spoken words are directly in front of the viewer. This can, in certain scenes, break viewer immersion. While utilizing the center channel may be easier to mix and utilize to replace spoken words with alternative languages, more accurate results can be achieved during the mix-down when utilizing acoustical footprint data and spatial data to better replicate the sound as it was within the original recording location, and provide the ability to provide alternative spoken word tracks that also mimic original recording track characteristics based on where the subject and/or camera was within the original scene.

Information as herein shown and described in detail is fully capable of attaining the above-described object of the present disclosure, the presently preferred embodiment of the present disclosure, and is, thus, representative of the subject matter that is broadly contemplated by the present disclosure. The scope of the present disclosure fully encompasses other embodiments that might become obvious to those skilled in the art, and is to be limited, accordingly, by nothing other than the appended claims. Any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for solutions to such problems to be encompassed by the present claims. Furthermore, no element, component, or method step in the present disclosure is intended to be dedicated to the public regardless of whether the element, component, or method step is explicitly recited in the claims. Various changes and modifications in form, material, work-piece, and fabrication material detail can be made, without departing from the spirit and scope of the present disclosure, as set forth in the appended claims, as might be apparent to those of ordinary skill in the art, are also encompassed by the present disclosure.

What is claimed is:

1. A method for generating multi-dimensional sound recordings, comprising:

positioning a plurality of multi-dimensional sound recording devices in a location;

positioning a plurality of multi-dimensional sound recording sensors within the location;

generating acoustical footprint data;

recording positional data within the location utilizing the plurality of multi-dimensional sound recording devices;

generating spatial data utilizing the recorded positional data;

storing the generated acoustical footprint data and spatial data;

generating an audio mix-down utilizing the stored acoustical footprint and spatial data;

generating a consumer-device audio track mix based on the audio mix-down;

wherein the multi-dimensional sound recording sensors comprise one or more of the group consisting of: microphones, tracking cameras, chroma data sensors, tracking units, depth cameras, and GPS units;

wherein the positional data is formatted into an audio signal; and wherein spatial data is generated from combining positional data from two or more multi-dimensional sound recording devices from the plurality of multi-dimensional sound recording devices.

2. The method of claim 1, wherein the spatial data is formatted into an audio signal.

3. The method of claim 2, wherein the formatted spatial data is recorded onto a location audio recording device.

4. A method for generating multi-dimensional sound recordings, comprising:

positioning a plurality of multi-dimensional sound recording devices in a location;

positioning a plurality of multi-dimensional sound recording sensors within the location;

generating acoustical footprint data;

recording positional data within the location utilizing the plurality of multi-dimensional sound recording devices;

generating spatial data utilizing the recorded positional data;

storing the generated acoustical footprint data and spatial data;

generating an audio mix-down utilizing the stored acoustical footprint and spatial data;

generating a consumer-device audio track mix based on the audio mix-down;

wherein the multi-dimensional sound recording sensors comprise one or more of the group consisting of: microphones, tracking cameras, chroma data sensors, tracking units, depth cameras, and GPS units; and wherein one of the multi-dimensional sound recording devices is a mobile computing device configured to execute one or more applications that direct the mobile computing device to record the positional data from the plurality of multi-dimensional sound recording sensors.

5. A method for generating multi-dimensional sound recordings, comprising:

positioning a plurality of multi-dimensional sound recording devices in a location;

positioning a plurality of multi-dimensional sound recording sensors within the location;

generating acoustical footprint data;

recording positional data within the location utilizing the plurality of multi-dimensional sound recording devices;

generating spatial data utilizing the recorded positional data;

storing the generated acoustical footprint data and spatial data;

generating an audio mix-down utilizing the stored acoustical footprint and spatial data;

generating a consumer-device audio track mix based on the audio mix-down;

wherein the multi-dimensional sound recording sensors comprise one or more of the group consisting of: microphones, tracking cameras, chroma data sensors, tracking units, depth cameras, and GPS units;

wherein the multi-dimensional sound recording sensors communicate with the multi-dimensional sound recording devices via a wireless connection; and wherein the wireless signal received from the multi-dimensional sound recording sensor is captured by at least three multi-dimensional sound recording devices which determine the position of the multi-dimensional sound recording sensor by triangulating the signals.

6. The method of claim 5, wherein the acoustical footprint data is artificially generated to match a desired location simulated within the chromakey studio location.

7. A method for generating multi-dimensional sound recordings, comprising:

positioning a plurality of multi-dimensional sound recording devices in a location;

positioning a plurality of multi-dimensional sound recording sensors within the location;

generating acoustical footprint data;

recording positional data within the location utilizing the plurality of multi-dimensional sound recording devices;

generating spatial data utilizing the recorded positional data;

storing the generated acoustical footprint data and spatial data;

generating an audio mix-down utilizing the stored acoustical footprint and spatial data;

generating a consumer-device audio track mix based on the audio mix-down;

wherein the multi-dimensional sound recording sensors comprise one or more of the group consisting of: microphones, tracking cameras, chroma data sensors, tracking units, depth cameras, and GPS units;

wherein the multi-dimensional sound recording sensors communicate with the multi-dimensional sound recording devices via a wireless connection; and wherein the triangulation occurs during the generation of spatial data.

* * * * *